US008534506B2

(12) United States Patent
Bohnisch et al.

(10) Patent No.: US 8,534,506 B2
(45) Date of Patent: Sep. 17, 2013

(54) DISPENSING PACK

(75) Inventors: Karsten Bohnisch, Kamen (DE); Bernhard Jasper, Waltrop (DE)

(73) Assignee: Seaquist Perfect Dispensing GmbH, Dortmund (DE)

( * ) Notice: Subject to any disclaimer, the term of this patent is extended or adjusted under 35 U.S.C. 154(b) by 907 days.

(21) Appl. No.: 10/566,563

(22) PCT Filed: Jul. 29, 2004

(86) PCT No.: PCT/EP2004/008524

§ 371 (c)(1),
(2), (4) Date: Aug. 28, 2006

(87) PCT Pub. No.: WO2005/016551

PCT Pub. Date: Feb. 24, 2005

(65) Prior Publication Data

US 2007/0007307 A1 Jan. 11, 2007

(30) Foreign Application Priority Data

Aug. 5, 2003 (DE) ..... 103 35 842

(51) Int. Cl.
*G01F 11/00* (2006.01)

(52) U.S. Cl.
USPC ..... 222/321.9; 222/105; 222/183; 222/385

(58) Field of Classification Search
USPC ..... 222/95, 105, 321.9, 256, 383.1, 321.2, 222/92, 183, 321.7, 385
See application file for complete search history.

(56) References Cited

U.S. PATENT DOCUMENTS

| | | | | |
|---|---|---|---|---|
| 4,008,830 | A * | 2/1977 | Meshberg | 222/95 |
| 4,322,020 | A * | 3/1982 | Stone | 222/95 |
| 4,986,453 | A * | 1/1991 | Lina et al. | 222/321.2 |
| 5,031,384 | A * | 7/1991 | Rebeyrolle et al. | 53/452 |
| 5,092,495 | A * | 3/1992 | Andre | 222/341 |
| 5,292,033 | A * | 3/1994 | Gueret | 222/95 |
| 5,417,258 | A | 5/1995 | Privas | |
| 6,021,924 | A | 2/2000 | Suck | |
| 6,047,856 | A * | 4/2000 | Meshberg et al. | 222/1 |

(Continued)

FOREIGN PATENT DOCUMENTS

| | | |
|---|---|---|
| DE | 27 10 984 | 9/1978 |
| DE | 27 10 984 A1 | 9/1978 |

(Continued)

OTHER PUBLICATIONS

Garcia Firmin, (EP 1 050 481) English translation.*

(Continued)

*Primary Examiner* — Paul R Durand
*Assistant Examiner* — Robert Nichols, II
(74) *Attorney, Agent, or Firm* — Wood, Phillips, Katz, Clark & Mortimer

(57) ABSTRACT

A dispenser pack for a free-flowing medium includes a metering pump, a container that is tightly connected to said metering pump and that can be ventilated by the pump, and a closing cap. The free-flowing medium within the container is enclosed by a bag made of a flexible material with an upper aperture rim of the bag being tightly connected in one part/piece to a wall of the container, and a space between the inside of the container wall and the outside of the bag being at atmospheric pressure.

21 Claims, 6 Drawing Sheets

(56) References Cited

U.S. PATENT DOCUMENTS

| | | | | |
|---|---|---|---|---|
| 6,266,943 | B1 * | 7/2001 | Nomoto et al. | 53/410 |
| 6,352,182 | B1 | 3/2002 | Gueret | |
| 6,360,919 | B1 * | 3/2002 | Brule | 222/189.09 |
| 6,398,079 | B1 | 6/2002 | Garcia et al. | |
| 6,415,962 | B1 * | 7/2002 | Bougamont et al. | 222/321.7 |
| 6,510,965 | B1 * | 1/2003 | Decottignies et al. | 222/95 |
| 6,974,055 | B2 * | 12/2005 | Moore et al. | 222/321.4 |
| 2001/0027154 | A1 | 10/2001 | Nomoto et al. | |
| 2004/0112921 | A1 | 6/2004 | Nomoto et al. | |
| 2004/0200860 | A1 | 10/2004 | Buxmann | |

FOREIGN PATENT DOCUMENTS

| | | | |
|---|---|---|---|
| DE | 77 07 773 | U1 | 1/1980 |
| DE | 695 02 295 | T2 | 5/1995 |
| EP | 0 342 651 | B1 | 11/1989 |
| EP | 0 759399 | A1 | 2/1997 |
| EP | 1 050 481 | A1 | 11/2000 |
| EP | 1 466 668 | A1 | 10/2004 |
| JP | 9-58750 | A | 3/1997 |

OTHER PUBLICATIONS

Garcia Firmin, (EP 1 050 481) English translation, May 21, 2009.*
German Language International Search Report for PCT/EP2004/008524.
German Language International Preliminary Examination Report for PCT/EP2004/008524.
English Abstract of JP 9-58750.
English Abstract of EP 1 050 481 A1.
German language Official Action dated "Jan. 3, 2004" from the priority German patent application No. 103 35 842.0.
Document E7 is technical drawing showing a bottle with an inner container and contains information "drawn on Mar. 13, 1997".
Document E9, relates to an excerpt from a technical encyclopedia dealing with various aspects of polymers and injection molding/extrusion techniques, Feb. 9, 2005.

* cited by examiner

DISPENSING PACK

This application is an application filed under 35 U.S.C. Sec. 371 as a national stage of international application PCT/EP2004/008524, which was filed Jul. 29, 2004.

TECHNICAL FIELD

This invention relates to a dispenser pack or dispensing pack.

BACKGROUND OF THE INVENTION

DE-A-0 342 651 B1 describes a manually operable metering pump with the characteristics contained in the precharacterising part of claim 1. The ability, provided by standard pumps of this known type, to ventilate a container equipped with such a pump encounters difficulties in those cases where the medium that is contained in the container and that is to be dispensed is highly viscous, such as e.g. creams, and is to be prevented from contacting environmental air so as to prevent loss of function of the pump and contamination of the medium by harmful germs or dirt particles contained in the air.

BRIEF SUMMARY OF THE INVENTION

It is the object of the invention to improve a dispenser pack of the type mentioned above such that, with the use of standard pumps that normally make possible ventilation of a container equipped with such a pump, the free-flowing medium contained in the container cannot come into contact with air and cannot be contaminated, so that possibly also the quantity of preservatives used in the free-flowing medium can be reduced. In particular, the dispensing of highly-viscous media such as e.g. the dispensing of commonly used cosmetics or medicated creams is possible not only with the exclusion of air but also when the dispenser pack is upside down. This object is to be able to be implemented by a relatively quick and simple retrofit of already existing automatic installation equipment.

The invention meets this object by the characteristics contained in claim 1. Accordingly, the invention starts with a dispenser pack that comprises a metering pump and a container that is tightly connected to said metering pump and that can be ventilated by the pump. The dispenser pack comprises a sealing or closing cap that can be attached to the neck of the container, as well as a cylindrical wall that encloses an axial aperture that is arranged above an internal flange. Furthermore, a retainer for attaching the pump within an aperture of the closing cap is provided, wherein an exterior flange of the retainer can be pressed against an annular seal on an outer face of the container neck so as to be sealed by the closing cap. A pump housing comprises a pump cylinder that surrounds a pump chamber whose upper end comprises an aperture and whose lower end comprises a suction pipe nipple. A pump piston is arranged in the pump chamber so as to be slidable in a sealed manner and comprises a piston shaft which protrudes outward from the pump chamber and at its outer end comprises an activation- and dispensing head. An axial outlet channel extends through the piston shaft and the pump piston and connects the pump chamber with a dispensing aperture of the activation head. Furthermore, an inlet valve and an outlet valve for the free-flowing medium are associated with the pump. A helical compression spring impinges on the pump piston in the direction of its home position.

The invention is characterised in that a volume of the container that contains a free-flowing medium can be adjusted to the decrease of the volume of the free-flowing medium dispensed from the container, and the inner hole rim of the seal between the container neck and the sealing cap rests against the outside of the pump housing so as to be airtight.

In this way a situation can be achieved in which the free-flowing medium does not establish contact with, and cannot be contaminated by, the air and with bacteria contained in the air and/or with other components contained therein that may be harmful to the medium to be dispensed, for example components such as oxygen or dirt particles.

A further improvement of the seal can be achieved in that the inner hole rim forms part of an annular lip. Preferably the thickness of the annular washer tapers off towards the outer end of the annular lip. Furthermore, it is recommended that the annular lip of the washer be formed such that it rests radially inward in the manner of a truncated cone transversely in an annular space against the cylindrical outside of the pump housing so as to provide a seal. In this way the seal can be pressed with increased pressure against the wall of the pump housing during a suction stroke of the pump piston so as to provide a seal.

According to one embodiment of the invention, inside the container the medium can be enclosed by a bag made of a flexible material, with the upper aperture rim of said bag being tightly connected to the wall of the container, while in a space between the inside of the container wall and the outside of the bag air at atmospheric pressure is contained. It is particularly preferred if the bag and the container are formed in one part. This is very advantageously carried out in that the aperture rim of the bag is injection-formed to the bottom end of the container neck. Due to the flexibility of the bag it collapses or shrinks to the extent to which the free-flowing medium is dispensed from the bag by means of the pump.

According to a second embodiment the container can comprise a cylindrical internal wall and be open at the bottom end into which a drag-flow piston is inserted so that it is axially movable and seals off the internal wall of the container, wherein said drag-flow piston, depending on the quantity of medium dispensed and the suction pressure exerted on the medium, is slidable in the direction of the pump. As the quantity of medium contained in the container is reduced, the drag-flow piston, which forms the bottom of the container, therefore travels, in the container, in the direction of the pump, i.e. in the normal upright position of dispensing it travels upwards.

In a particularly preferred embodiment the aperture of the suction pipe nipple is freely exposed. The absence of a suction pipe above all provides advantages in those cases where the free-flowing medium is highly viscous, such as for example in the case of skin creams or sun creams and also in the case of medicated creams. At the same time this provides an advantage in that the dispenser pack can not only be used in the upright position, but also in any other position, e.g. upside down.

Below, the invention is described in more detail with reference to diagrammatic drawings of two embodiments. The following are shown:

DETAILED DESCRIPTION OF THE INVENTION

FIGS. 1 to 4 show a longitudinal section of several components of the dispenser pack, which components are predominantly made from a relatively hard plastic, such as for example polypropylene. These components are arranged so as to be rotationally symmetrical, and constitute the dispenser pack in relation to a central longitudinal axis 0-0.

Figure 1:
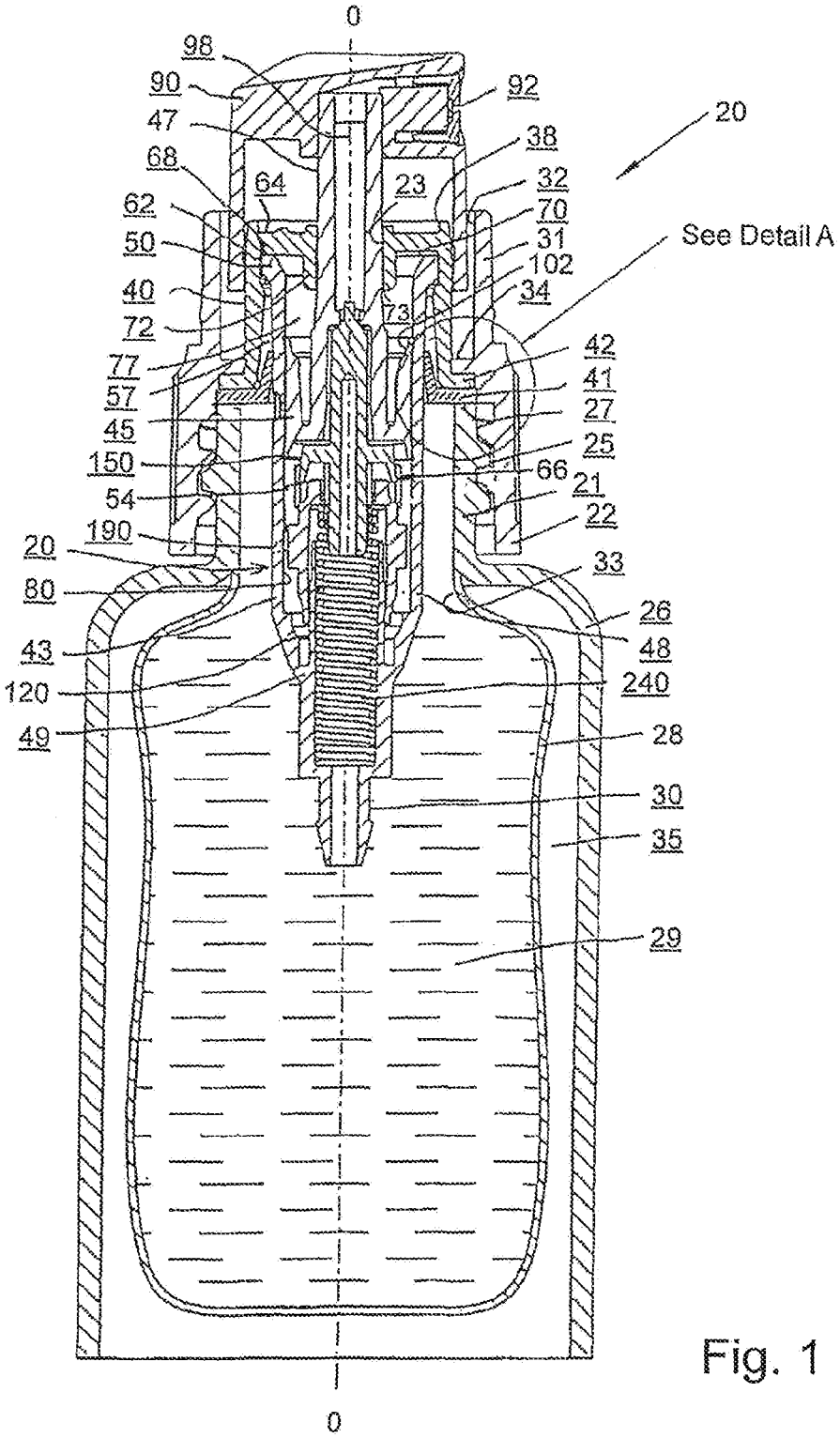
FIG. 1 a partially broken longitudinal section of a dispenser pack according to the invention, in which a bag that contains the medium to be dispensed as an integral component of the container is surrounded by air at atmospheric pressure.
Figure 2:
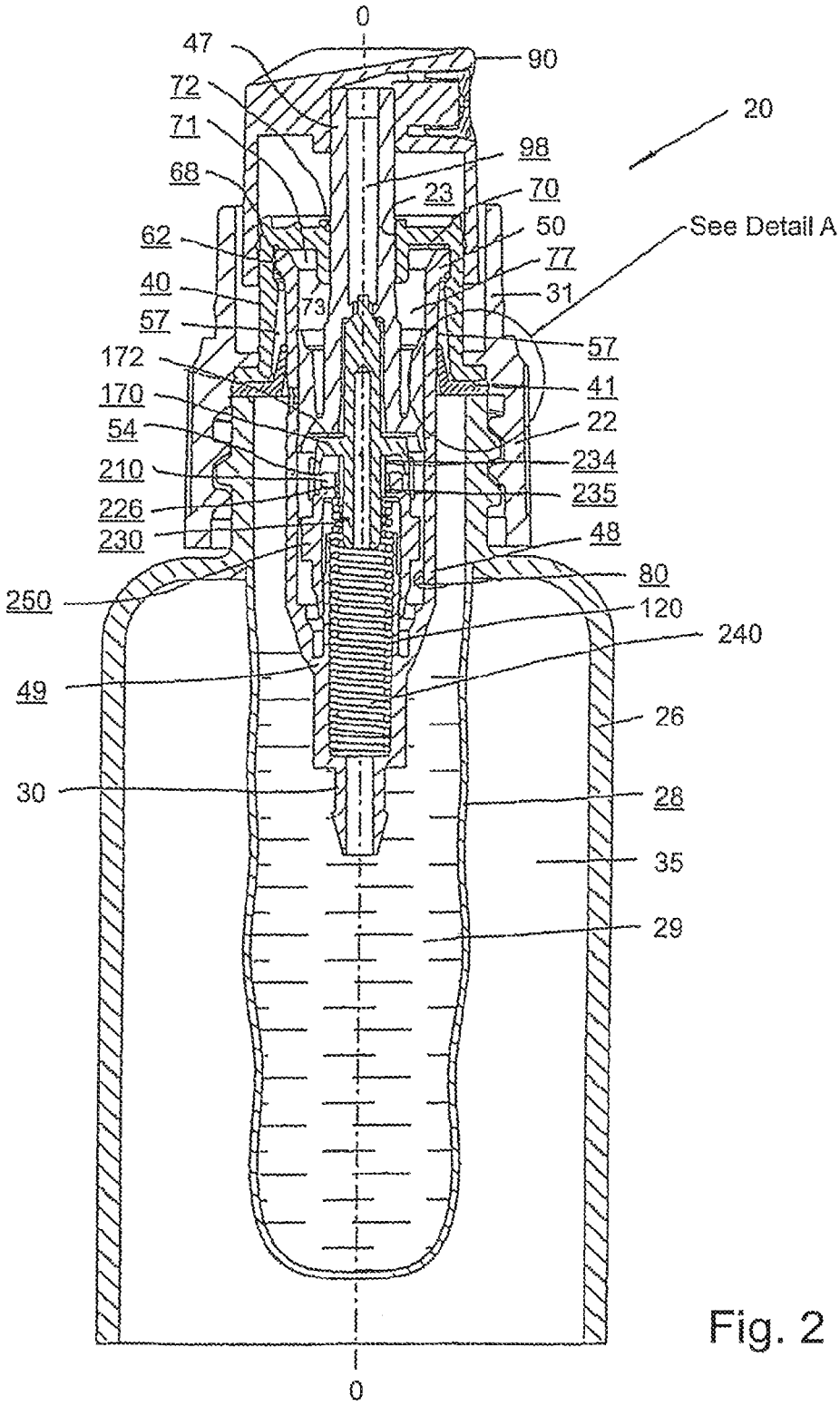
FIG. 2 the dispenser pack according to FIG. 1, with the bag being almost empty.

According to FIGS. 1 and 2 the dispenser pack comprises a metering pump 20 and a container 26, tightly connected to said metering pump 20, to which container a bag 28 made of a flexible material is tightly connected, which bag contains a free-flowing medium 29, preferably a sprayable liquid such as for example normal or medicated skin cream whose quality can be contaminated by exposure to air, e.g. by bacteria contained therein, so that the dispenser pack according to the invention is to prevent such exposure to air by the medium contained in the container and at the same time is to reduce the quantity of preservatives that have to be added to the medium 29.

A sealing or closing cap 22 is attached to the neck 21 of the container 26 by means of a common screw thread 25. At its upper end the closing cap 22 comprises a wall 31 with an inner cylindrical aperture 32 which is arranged above an internal flange 34. A retainer 38 is provided for the pump 20, which retainer 38 comprises a cylindrical external wall 40 and is arranged within the aperture 32 of the closing cap 22 and which retainer 38 at its bottom end comprises an exterior flange 42. This exterior flange 42 can be pressed against an annular seal 41 on an outer face 27 of the container neck 21 so as to provide a seal with the interior flange 34 of the closing cap 22. The function of this seal 41 will be explained below. Instead of a screw thread 25 the closing cap 22 can also be connected to the container neck 21 by means of pressing, welding, gluing or the like, in a way that is known per se.

A pump housing 48 comprises a pump cylinder 43 which below the annular seal 41 comprises a small ventilation aperture 51 which connects the internal volume of the bag 28 to the pump chamber 80 and is used for ventilating the pump cylinder 43 during initial operation of the metering pump 20.

The pump cylinder 43 surrounds a pump chamber 80 that is open towards the top or the outside. A cylindrical internal wall 72 of the retainer 38 coaxially engages the top aperture of the pump chamber 80 and is connected to said pump chamber 80 at the top end by an annular end wall 64. At the top end the pump housing 48 comprises an outward-projecting annular flange 50, which is inserted so as to clip into an annular groove 62 at the inner upper end of the retainer 38. At the bottom end of the pump housing 48 a suction pipe nipple 30 is formed, through which the free-flowing medium 29 within the bag 28 made of a flexible material is sucked in. The aperture of the suction pipe nipple 30 has been left free intentionally in order to also make it possible to suck highly viscous media, such as e.g. creams, and to maintain the dispensing function of the pump even if the dispensing pack is upside down.

The bag 28 tightly encloses the medium 29 in that the top aperture rim 33 is tightly connected to the wall of the container 26, in the present case with the bottom end of the container neck 21. For this purpose, during manufacture of the container 26 the top end of the bag 28 has been injection-formed, in one piece, in the plastic injection moulding process, to the bottom end of the container neck 21. If need be it is of course also possible to tightly clamp the aperture rim of a bag for the liquid medium 29, which bag has been produced separately from the container 26, between the retainer 38 and the upper end of the container neck 21 or to glue it together or weld it together in a gas-proof manner with the container neck 21. Between the outside of the bag 28 and the inside of the container 26 an annular space 35 is provided which contains ambient air at atmospheric pressure.

A pump piston 45 is slidable in a sealed manner in the pump cylinder 43 and comprises a hollow-cylindrical piston shaft 47 that protrudes from the pump chamber 80 through a cylindrical aperture 23 in the end wall 64 of the retainer 38, and at its outer end comprises an activation- and dispensing head 90. An axial outlet channel 98 extends through the piston shaft 47 and the pump piston 45, and connects the pump chamber 80 with a dispensing aperture 92 of the activation head 90. A sealing lip 102, 103 each, of annular shape, is formed to the top and bottom end of the pump piston 45, which sealing lips rest tightly with elastic pre-tension against the internal wall of the pump cylinder 43. In the home position of the pump piston 45 its top end rests against the bottom end 73 of the cylindrical internal wall 72 of the retainer 38 so as to provide a seal.

The pump housing 48 comprises a bottom 49 from which a cylindrical tubular feed piece 120 protrudes coaxially to the suction pipe nipple 30 into the pump chamber 80.

Figure 6:
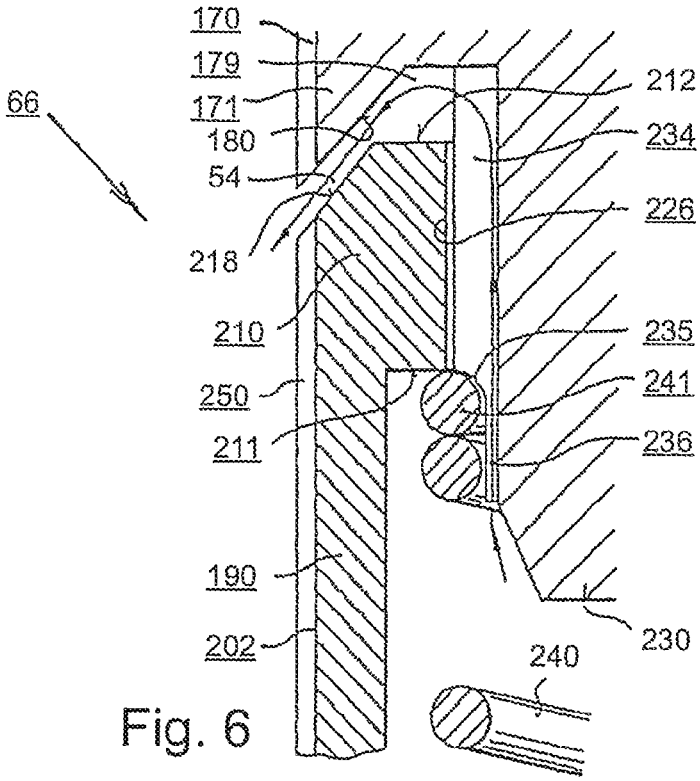
FIGS. 6 and 7 a detail of an inlet valve, shown in FIGS. 1 to 4, in its open and closed positions respectively.
Figure 7:
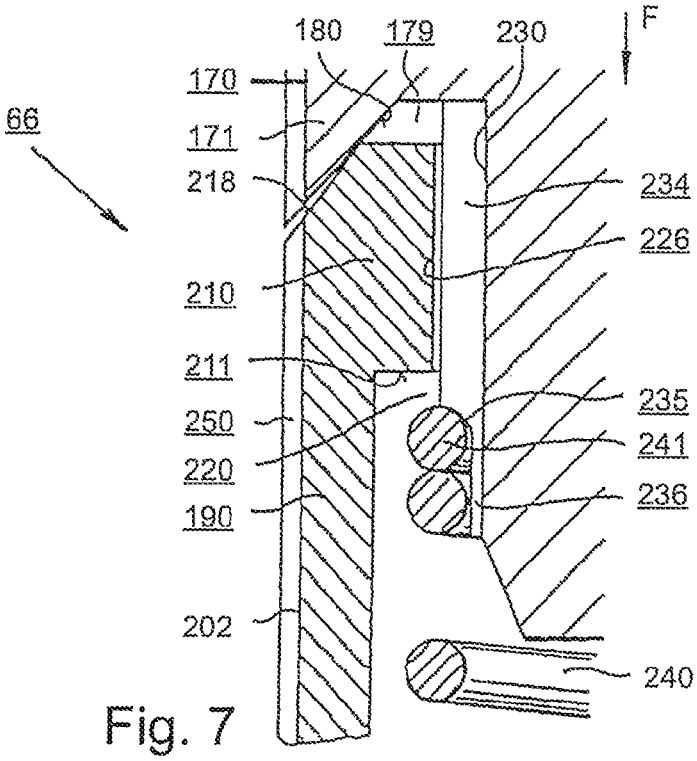

An inlet valve 66 is designed as a two-part differential piston and comprises a valve body 150 underneath the pump piston 45, and a seal sleeve 190, arranged underneath the valve body 150, which seal sleeve 190 comprises guide ribs 250 arranged at identical circumferential angle spacing (FIGS. 2, 6 and 7). The valve body 150 and the seal sleeve 190 are guided between the pump piston 45 and the feed piece 120 in the pump chamber 80 so as to be axially slidable.

The seal sleeve 190 is axially slidable to a limited extent in relation to the valve body 150, and forms a connecting channel 54 between the pump chamber 80 and the outlet channel 98 with a valve head 170 of the valve body 150 (FIGS. 2 and 6), which valve body 150 is closed during the pumping stroke of the pump piston 45, and is open during the suction stroke of said pump piston 45 (FIGS. 6 and 7). In FIG. 2 a cylindrical aperture 226 in the top end of the seal sleeve 190 is provided, which cylindrical aperture 226 is enclosed by an internal flange 210 of the seal sleeve 190. A guide pin 230 of the valve body 150 extends coaxially through this aperture 226 and comprises longitudinal ribs 234. A helical compression spring 240, whose bottom end is supported by the housing bottom 49 and whose top end is supported by bottom faces 235 of the longitudinal ribs 234 of the guide pin 230 is used as a bearing for the internal flange 210 of the seal sleeve 190 in the home position of the pump piston 45 as well as during its suction stroke (FIGS. 2, 6 and 7).

Figure 3:
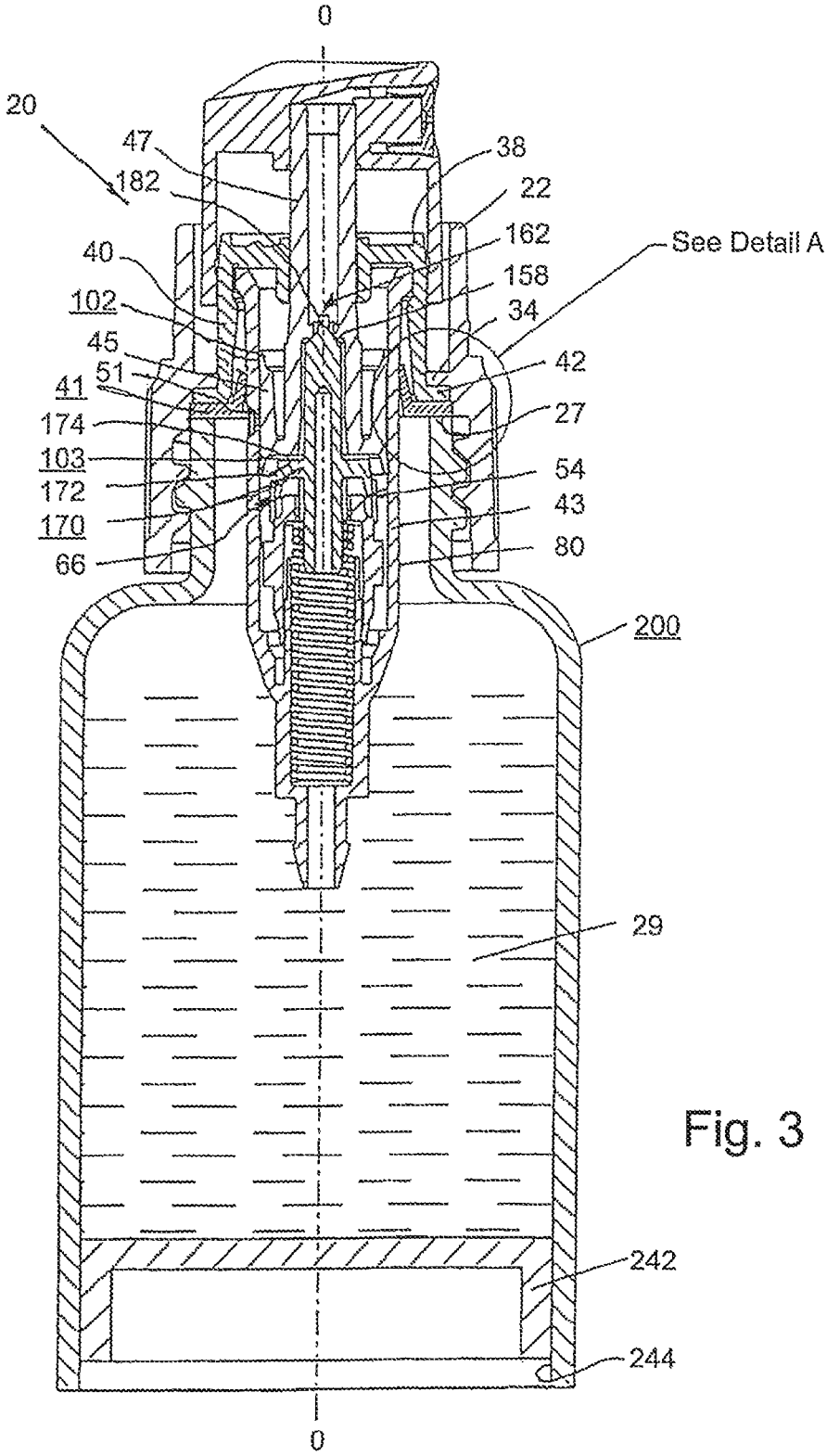
FIG. 3 a longitudinal section of a second embodiment of a dispenser pack in which a drag-flow piston that seals off the container has been inserted in the open bottom end of a container.
Figure 4:
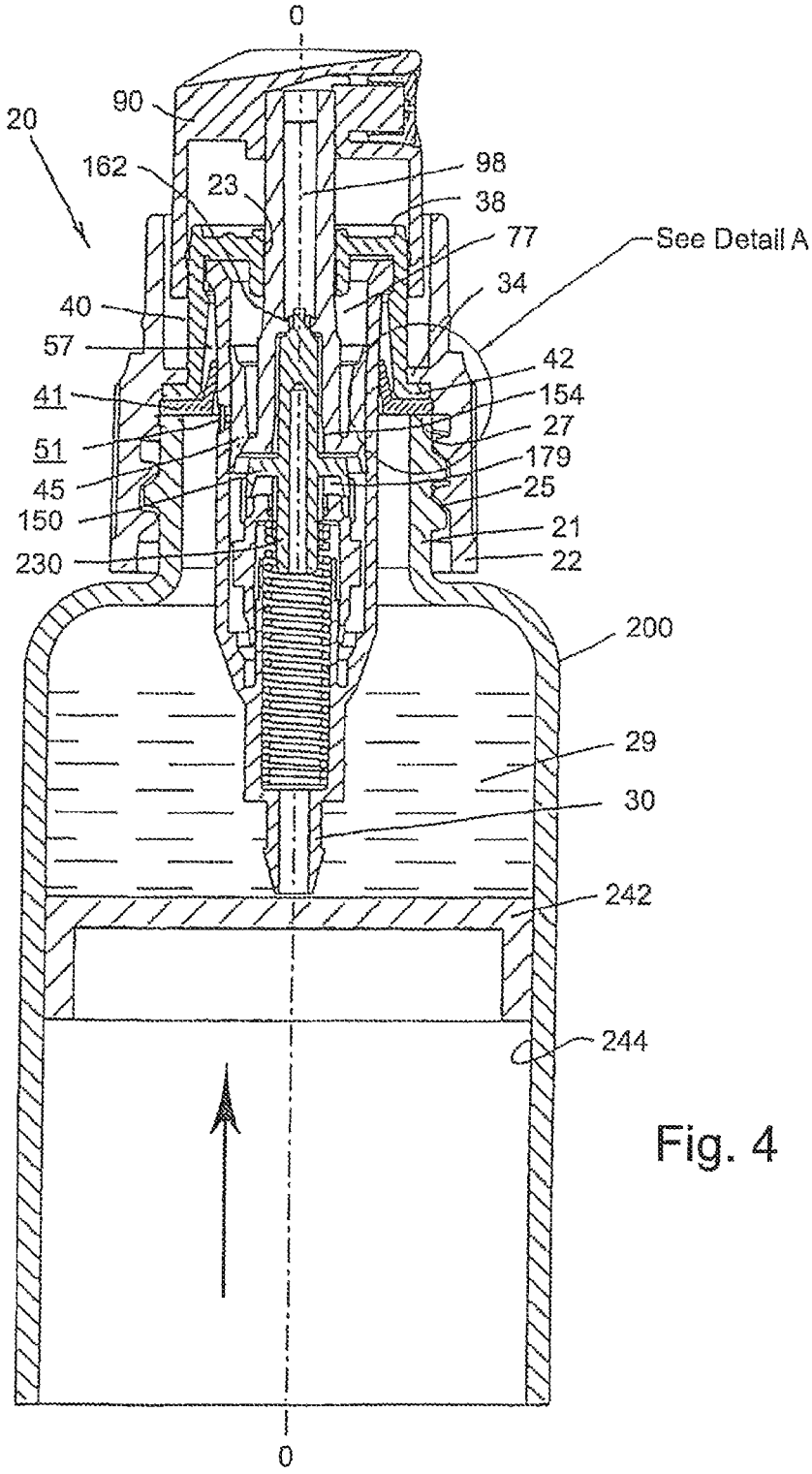
FIG. 4 the dispenser pack according to FIG. 3, in an almost empty state.
Figure 5:
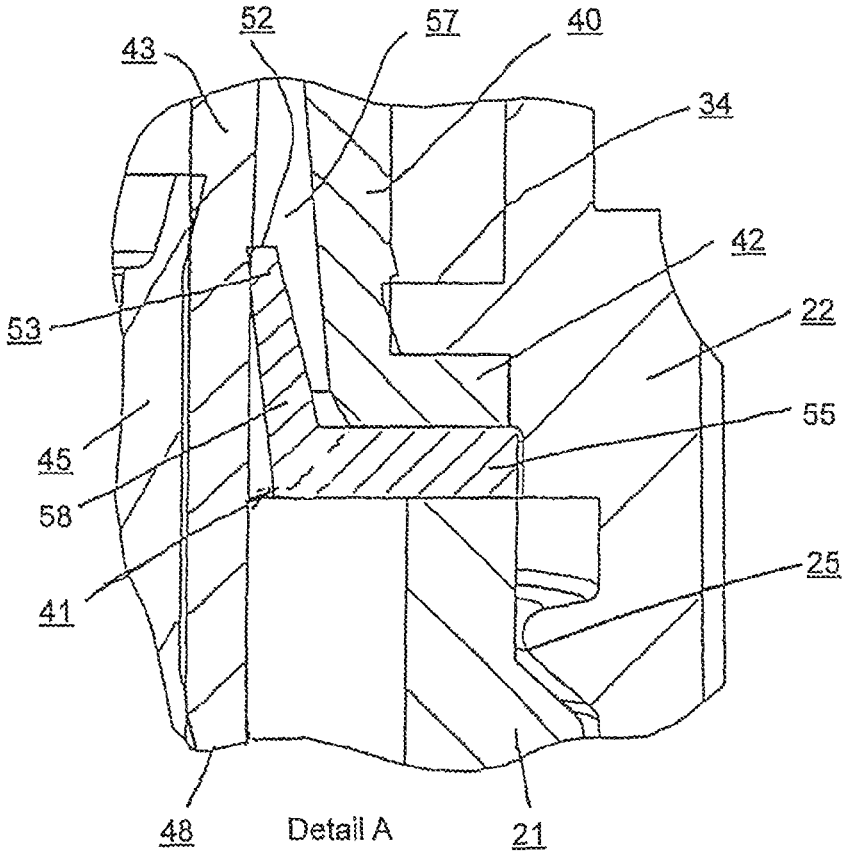
FIG. 5 an enlarged view of detail A shown in FIGS. 1 to 4.

FIG. 5 shows a mirror image, at an enlarged scale, of the detail designated A in FIGS. 1 to 4, which detail relates to the annular seal 41 that is clamped between the container neck 21 and the closing cap 22 and according to the invention rests with its inner hole rim 52 against the outside of the pump housing 48 so as to be gas-proof. In this arrangement the inner hole rim 52 is formed in the manner of an annular lip 53 whose thickness is reduced in the direction of the inner hole rim 52. The seal 41 extends from the inside of an outer horizontally arranged annular rim 55 radially inward and upward or outward in the form of a truncated cone 58 into an annular space 57 which is enclosed by the cylindrical outside of the pump housing 48 and of the outside wall 40 of the retainer 38 in the sealing cap 22. The seal 41 preferably comprises silicon or some other rubber-like elastomeric material that is inert in relation to the medium 29 contained in the container 26.

The annular flange 50 at the top end of the pump housing 48 comprises a vertical groove 62, which in FIGS. 1 to 4 is shown in the left half of the illustrations. The groove 62 forms an air outlet slot between the pump housing 48 and the external wall 40 of the retainer 38 and interacts with radial air channels 70 in the retainer 38. The upper end wall 64 of the retainer 38 has a circumferential groove 68 on the underside of the retainer 38. The groove 68 is connected to the top of the groove 62. In a position that is offset by 180° in relation to the groove 62, the groove 68 is connected to the radial air channels 70 that are provided in the underside of the top end wall 64 of the retainer 38. The air channels 70 extend inward along the wall of the pump housing 48 into the annular space 57 that is sealed off towards the inside or towards the bottom by the seal 41.

The top interior rim of the pump housing 48 is conically enlarged towards the top and forms an annular channel 71 around the retainer 38. The clearance between the cylindrical internal wall 72, the piston shaft 47 and the wall of the pump chamber 80 connects an annular space 77 at the bottom end of the cylindrical internal wall 72 of the retainer 38 to the annular channel 71, which extends around the top end of the pump housing 48. This results in a ventilation channel which extends from the interior of the pump housing 48 through the radial air channels 70, around the circumferential groove 68, through the groove 62 inward or downward between the inside of the cylindrical external wall 40 and the outside of the pump housing 48 right up to the seal 41. The annular seal 41 prevents air ingress into the bag 28 and thus prevents any contact of the free-flowing medium 29 contained in the bag 28 with outside air, so that the quality of the medium 29 is maintained by excluding the external air.

In the case of a partially or fully depressed pump piston 45 the concave sealing lip 102 of the pump piston 45 is separated from the bottom end 73 of the internal wall 72 of the retainer 38. An annular space 77 thus results between the outside of the upper section, of reduced diameter, of the downward moving piston shaft 47 and the bottom end 73 of the internal wall 72 of the retainer 38.

During movement of the pump piston 45 into the bottom end position of the pump stroke the air flows through the annular gap 23 along the internal wall 72 of the retainer 38 and the pump housing 48 through the radial air channels 70 into the circumferential groove 68. Here the air is distributed in both directions around the circumference of the retainer 38 across approximately 180° where it then flows through the groove 62 into the annular space 57 of the pump housing 48. After this, the air is prevented from entering the bag 28 by the annular seal 41 which in the subsequent suction stroke of the pump piston 45, due to the resulting pressure difference between the interior of the bag 28 and the exterior air, is present in the pump housing 48 at increased pressure. The free-flowing medium 29 is sucked from the bag 28 through the suction pipe nipple 30 into the pump chamber 80, wherein the bag 28 shrinks as it adapts to the reducing volume of the medium 29. Furthermore, the pump piston 45 has an enlarged bore 154, whose top end forms an annular valve seat 158 of an outlet valve in the outlet channel 98.

At the top end the valve body 150 is shaped so as to form a valve cone 182 of the outlet valve, which valve cone rests tightly against the annular valve seat 158 in the pump piston 45 so as to prevent the medium 29 from flowing from the pump chamber 80 through the outlet channel 98. The valve body 150 has a valve head 170 with a top head surface 172 that comprises radial ribs 174 (FIG. 3) which, arranged at even circumferential angle spacing, extend radially outward and protrude from the top head surface 172.

The underside of the valve head 170 comprises an annular groove 179 (FIG. 6) which is trapezoidal in cross section and forms an integral part of the inlet valve 66. To this purpose the outer side wall of the annular groove 179 forms a valve surface 180 that expands conically downward and outward in order to provide a seal with the top conical contact surface 218 of the seal sleeve 190. The contact surface 218 is connected to the valve body 150 such that it is axially adjustable to a limited extent. The valve surface 180 and the conical contact surface 218 essentially form the connecting channel 54 in the shape of a truncated cone, wherein the internal side wall of the annular groove 179 is formed by the cylindrical guide pin 230.

FIGS. 6 and 7 clearly show that the seal sleeve 190 at its face facing the container comprises an essentially cylindrical piston mantle 202. The top end of the seal sleeve 190 comprises an annular internal flange 210 whose underside forms an annular support 211 that rests on the top end 241 of the helical compression spring 240 when the pump piston 45 is in its top home position. In this home position the inlet valve 66 with its connecting channel 54 is open (FIG. 6). The internal flange 210 can be axially moved from its home position to an operating position in which the connecting channel 54 of the inlet valve 66 is closed. The support surface 211 and the top 212 of the internal flange 210 extend at a right angle to the pump axis 0-0 as well as extending axially into the annular groove 179 of the valve head 170.

The helical compression spring 240 comprises a spring wire of round cross section. The diagram shows that the top end 241 of the spring 240 with the inner half of the wire cross section rests against the face 235 of the longitudinal ribs 234, i.e. across a tangential angle of approximately 80°. Lower longitudinal sections 236 of the longitudinal ribs 234 radially protrude only by about a third of the width of the longitudinal ribs 234. Optionally, instead of a spring wire of circular cross section a spring wire of some other cross section, e.g. of rectangular cross section can be used, provided the diameter of the spring wire exceeds the radial width of the longitudinal ribs 234 so that part of the wire cross section forms the support for the annular support surface 211 of the seal sleeve 190. If necessary a washer can be arranged between the upper end 241 of the compression spring 240 and the face 235 of the longitudinal ribs 234, which washer extends parallel to the support surface 211 and the faces of the longitudinal ribs 234. Due to this bottom end stop, which is created by the top end 241 of the compression spring 240 for the seal sleeve 190, a clearance 220 (FIG. 7) is created which allows limited axial movement between the valve body 150 and the seal sleeve 190. This relative mobility of the seal sleeve 190 has been selected such that the contact face 218 of the seal sleeve 190 rests against the inner valve surface 180 of the exterior rim 171 of the valve head 170 in one end position of the relative movement region of the seal sleeve 190 so that the inlet valve 66 formed by the aforementioned parts is enclosed. The bottom end of the seal sleeve 190 has been dimensioned such that it can be slid telescopically and so that it provides a seal in close contact with the outside of the fixed tubular feed piece 120.

The components of the pump 20 can be produced from thermoplastic materials. The spring 240 preferably comprises stainless steel. Expediently, the pump housing 48 with the tubular feed piece 120 is made from polypropylene. Other internal components such as for example the pump piston 45, the valve body 150 and the seal sleeve 190 or parts of these other components can be made from polyethylene so as to provide better sealing performance. Due to the axially limited mobility in relation to the valve body 150, the movable seal sleeve 190 can be pressed directly onto the guide pin 230 of the valve body 150 without contacting other components, after which the top end of the compression spring 240 is pressed onto the guide pin 230 and consequently the seal sleeve 190 is to a limited extent kept axially mobile on the valve body 150.

In its home position the seal sleeve 190 assumes the end position, as shown in FIGS. 1 to 4 and 6, in relation to the valve head 170. When the pump 20 is activated the pump piston 45 and the valve body 150 move downward in the pump housing 48, wherein the compression spring 240 is compressed. The seal sleeve 190 temporarily follows this movement while the internal flange 210 with its annular support surface 211 is supported by the compression spring 240. When the bottom free end of the seal sleeve 190 contacts the tubular feed piece 120 the movement of the seal sleeve 190 is briefly interrupted. The top end of the seal sleeve 190 is quickly reached by the valve head 170 so that both components take up the closed position shown in FIG. 7. From this point onwards the valve head 170 guides the seal sleeve 190 down with it so that the seal sleeve 190 is pushed telescopically, and so as to provide sealing action, onto the tubular feed piece 120. The friction that occurs in this process contributes to the relative pressure of the internal flange 210 acting on the annular groove 179 so that the connecting channel 54 between the contact surface 218 of the seal sleeve 190 and the valve surface 180 of the valve head 170 is closed or sealed off. From this moment onward, which commences immediately after activation of the pump 20, the pump chamber 80 is completely closed. By further depressing the pump piston 45 the pressure within the pump chamber 80 is increased.

However, this increase depends on the selection of the position at which the internal flange 210 is supported on the valve body 150. For, as long as the pressure in the pump chamber 80 increases, an axial outward directed force is added to the friction between the seal sleeve 190 and the feed piece 120.

As soon as there is no longer any pressure exerted on the pump piston 45, the compression spring 240 pushes the valve body 150 back. The valve body 150 thus moves away from the seal sleeve 190, which due to the friction stays back at the tubular feed piece 120. The seal sleeve 190 then moves from the closed position to the open position. The connecting channel 54 between the valve head 150 and the internal flange 210 of the seal sleeve 190 is then open and connects the container 26 to the pump chamber 80 by way of the clearances or grooves between the longitudinal ribs 250. The compression spring 240 on which the inner support surface 211 of the internal flange 210 rests then at the same time takes the seal sleeve 190 and the valve body 150 along towards the top. In this way the volume of the pump chamber 80 increases. Because the connecting channel 54 is open, the medium 29 can flow into the pump chamber 80. The connecting channel 54 makes it possible to fill the pump chamber 80 to the extent to which the volume of the pump chamber 80 increases. When the pump 20 has reached its top home position, in which the seal sleeve frees itself of the top end 121 of the tubular feed piece 120, liquid medium 29 can no longer enter the pump chamber 80 by way of said tubular feed piece 120.

When the metering pump 20 is operated the connecting channel 54 thus closes almost at the same point in time at which the seal sleeve 190 is pushed onto the feed piece 120. However, when the pump piston 45 moves upward the connecting channel 54 opens before the seal sleeve 190 separates from the feed piece 120. This results in a significantly smaller vacuum in the pump chamber 80. Consequently, if at all, air can enter only to a lesser extent, even in a case where sealing of the pump piston 45 in relation to the pump cylinder 43 happens not to be fully ensured. For sealing the pump piston 45 there is a lower sealing lip 103 that faces the container 26 so that during dispensing of the free-flowing medium 29 the pressure prevailing in the pump chamber 80 increases the sealing effect.

The two interacting parts 150 and 190 of the inlet valve 66 therefore interact by way of the compression spring 240 and make it possible for the liquid medium 29 during operation of the metering pump 20 to be sucked into the pump chamber 80. When the pump chamber 80 is filled with air during the first pump stroke, the pressure in the pump chamber 80 during downward movement of the movable parts 45, 150, 190 in the pump housing 48 is not increased to such an extent that the outlet valve 162 could open. The connecting channel 54 between the pump chamber 80 and the container 26 opens immediately at commencement of the upward movement of the pump piston 45 so that the air in the pump chamber 80 can spread out while being prevented by the seal 41 from entering the bag 28. During further upward movement of the pump piston 45 the volume of the pump chamber 80 increases and therefore creates a vacuum that leads to accelerated filling of the pump chamber 80 with the liquid medium 29.

The embodiment of a dispenser pack shown in FIGS. 3 and 4 contains the same pump 20 as the first embodiment described with reference to FIGS. 1, 2 and 5 to 7. In this second embodiment merely another way of storing the free-flowing medium 29, for example in a bottle-shaped container 200 with a rigid wall, is provided, whose bottom is formed by a drag-flow piston 242 that is axially movable on the rigid cylindrical internal wall 244 of the container 200 so as to provide a seal, such that after a certain quantity of the liquid medium 29 has been removed as a result of the suction pressure exerted by the pump 20, the drag-flow piston 242 is lifted in the container 200 to an extent that approximately corresponds to the volume of the quantity of the liquid medium 29 dispensed by the pump 20. In this embodiment too the liquid medium 29 is sucked into the pump chamber 80 due to the suction pressure exerted by the pump 20. Since for the remainder the construction of the pump 20 is identical to the construction described in the context of FIGS. 1, 2 and 5, to this extent reference is made to the above-mentioned description of the pump 20.

In summary, the function of the dispenser pack according to the invention can be described as follows: during the first pump stroke the air present underneath the pump piston 45 is displaced into the bag 28/container 200 and after exiting from the suction pipe nipple 30 rises in the free-flowing medium 29 within the bag 28/container 200 above the level of the medium 29. At the same time the pump piston 45 sucks air from the free atmosphere through the annular gap 23. Furthermore, a small vacuum arises in the annular space 57 between the outer circumferential surface of the pump housing 48 and the inside of the cylindrical wall 40 of the retainer 38, because the annular space 77 is connected by way of the channels 62, 68, 70 to this annular space 57 above the seal 41. However, the resulting suction pressure is too small to be able to lift the seal 41 from the outside of the pump cylinder 43.

Because the suction pipe nipple 30 is situated far below the level of the free-flowing medium 29, during the subsequent suction stroke only the free-flowing medium 29 is sucked into the pump chamber 80. The air above the pump piston 45 escapes through the annular gap 23 in the end wall 64 of the retainer 38. In this process a small quantity of air is pressed through the channels 62, 68, 70 into the annular gap 57 as a result of which the seal pressure of the seal 41 to the outside of the pump cylinder 43 is further increased and in this way the medium 29 in the bag 28/container 200 is even better protected against the effect of interaction with air.

In a following pump stroke, after short stroke travel the through channel between the sealing body 170 and the seal sleeve 190 closes as a result of the pressure increasing in the pump cylinder 43 and as a result of the frictional resistance which the seal sleeve 120 is subjected to when it is slid onto the tubular feed piece 120. With further increasing pressure in the pump cylinder 43 the seal cone 162 of the valve body 170 with the seal sleeve 120 is raised from its valve seat 158 in the piston shaft 47 against the pressure of the compression spring 240 so that the free-flowing medium 29 is dispensed through the dispensing head 90. It should thus be noted that due to sealing the pump housing 48 off from the container neck 21 by means of the seal 41 the described dispenser pack according to the invention prevents air ingress and thus deterioration of the quality of a liquid medium 29 contained in the bag 270 of the container 26, or contained in the container 200 itself, without this requiring any further design change of the pump 20, which in the case of the pump housing 48 not being sealed off from the container neck 21 and from the sealing cap 22 can be used for free-flowing media that are insensitive to contact with air. Furthermore, it is understood that the invention is not limited to the use of the above-described standard pump but can be applied to any pumps that make possible ventilation of the associated container and its free-flowing content and that can be retrofitted for the purpose according to the invention.

What is claimed is:

1. A dispenser pack comprising a standard metering pump and a container that is tightly connected to said metering pump, comprising a closing cap that can be attached to a neck of the container, having a cylindrical wall that encloses an axial aperture that is arranged above an internal flange;

a retainer for attaching the pump within the aperture of the closing cap, wherein an exterior flange of the retainer can be pressed against an annular seal on an outer face of the container neck so as to be sealed by the closing cap;

a flow path defined between the retainer and the pump;

a pump housing comprising a pump cylinder that surrounds a pump chamber, the retainer being a separate component from the pump housing;

a pump piston which is arranged in the pump chamber so as to be slidable in a sealed manner and comprises a piston shaft which protrudes outward from the pump chamber and at its outer end comprises an activation and dispensing head;

an axial outlet channel that extends through the piston shaft and the pump piston and connects the pump chamber to a dispensing aperture of the activation head;

an inlet valve and an outlet valve for a free-flowing medium; and a helical compression spring which impinges on the pump piston, the volume of the container that contains the free-flowing medium can be adjusted to the decrease of the volume of the free-flowing medium to be dispensed from the container; and the annular seal having an inner hole rim resting against the outside of the pump housing so as to close the flow path to prevent ventilation of the container through the flow path, and wherein the annular seal comprises an annular lip which forms the hole rim and is pressed radially inward in the form of a truncated cone across an annular space in the flow path against the cylindrical outside of the pump housing so as to seal the flow path, the annular lip having a radial thickness that provides a radial space between the annular lip and the retainer.

2. The dispenser pack according to claim 1, wherein the thickness of the annular lip is reduced towards its outer end.

3. The dispenser pack according to claim 1, wherein an upper end of the pump housing comprises an aperture and a lower end of the pump housing comprises a suction pipe nipple.

4. The dispenser pack according to claim 3, wherein the aperture of the suction pipe nipple is freely exposed.

5. The dispenser pack according to claim 1, wherein the medium within the container is enclosed by a bag made of a flexible material, with an upper aperture rim of that bag being tightly connected to the wall of the container, while in a space between the inside of the container wall and the outside of the bag air at atmospheric pressure is contained.

6. The dispenser pack according to claim 5, the aperture rim of the bag has been injection-molded to the bottom end of the container neck.

7. The dispenser pack according to claim 5, wherein the bag and the container have been formed in one piece.

8. A dispenser pack comprising a standard metering pump and a container that is tightly connected to said metering pump, comprising a closing cap that can be attached to a neck of the container, having a cylindrical wall that encloses an axial aperture that is arranged above an internal flange;

a retainer for attaching the pump within the aperture of the closing cap, wherein an exterior flange of the retainer can be pressed against an annular seal on an outer face of the container neck so as to be sealed by the closing cap;

a ventilation channel formed between the retainer and the pump, wherein the ventilation channel is connectable to the environment in an operable or assembled state of the dispenser pack;

a pump housing comprising a pump cylinder that surrounds a pump chamber, the retainer being a separate component from the pump housing;

a pump piston which is arranged in the pump chamber so as to be slidable in a sealed manner and comprises a piston shaft which protrudes outward from the pump chamber and at its outer end comprises an activation and dispensing head;

an axial outlet channel that extends through the piston shaft and the piston and connects the pump chamber to a dispensing aperture of the activation head; an inlet valve and an outlet valve for a free-flowing medium; and a helical compression spring which impinges on the pump piston, wherein the volume of the container that contains the free-flowing medium can be adjusted to the decrease of the volume of the free-flowing medium to be dispersed from the container, wherein the annular seal has an inner hole rim resting against the outside of the pump housing so as to close the ventilation channel to prevent ventilation of the container through the ventilation channel, and wherein the annular seal comprises an annular lip which forms the hole rim and is pressed radially inward in the form of a truncated cone across an annular space in the ventilation channel against the cylindrical outside of the pump housing so as to seal the ventilation channel, the annular lip having a radial thickness that provides a radial space between the annular lip and the retainer.

9. The dispenser pack according to claim 8, wherein the thickness of the annular lip is reduced towards its outer end.

10. The dispenser pack according to claim 8, wherein the medium within the container is enclosed by a bag made of a flexible material, with the upper aperture rim of that bag being tightly connected to the wall of the container, while in a space between the inside of the container wall and the outside of the bag air at atmospheric pressure is contained.

11. The dispenser pack according to claim 10, wherein the bag and the container have been formed in one piece.

12. The dispenser pack according to claim 10, wherein the aperture rim of the bag has been injection-moulded to the bottom end of the container neck.

13. The dispenser pack according to claim 8, wherein an upper end of the pump housing comprises an aperture and a lower end of the pump housing comprises a suction pipe nipple.

14. The dispenser pack according to claim 13, wherein the aperture of the suction pipe nipple is freely exposed.

15. A dispenser pack comprising a standard metering pump and a container that is tightly connected to said metering pump, comprising a closing cap that can be attached to a neck of the container, having a cylindrical wall that encloses an axial aperture that is arranged above an internal flange;

a retainer for attaching the pump within the aperture of the closing cap, wherein an exterior flange of the retainer can be pressed against an annular seal on an outer face of the container neck so as to be sealed by the closing cap;

a pump housing comprising a pump cylinder that surrounds a pump chamber, the retainer being a separate component from the pump housing;

a pump piston which is arranged in the pump chamber so as to be slidable in a sealed manner and comprises a piston shaft which protrudes outward from the pump chamber and at its outer end comprises an activation and dispensing head;

a ventilation channel for ventilation of the container formed between the retainer and the pump, wherein during operation of the pump a first end of the ventilation channel is temporary connectable to the environment and a second end is connected to a space between the retainer and pump housing;

a sealing lip formed at the top of the pump piston, wherein in a home position of the pump piston the sealing lip and the retainer form a closure for the first end of the ventilation channel, and wherein the closure can be opened by movement of the pump piston;

an axial outlet channel that extends through the piston shaft and the piston and connects the pump chamber to a dispensing aperture of the activation head;

an inlet valve and an outlet valve for a free-flowing medium; and a helical compression spring which impinges on the pump piston in the direction of its home position, wherein the volume of the container that contains the free-flowing medium can be adjusted to the decrease of the volume of the free-flowing medium to be dispersed from the container, wherein the annular seal has an inner hole rim resting against the outside of the pump housing so as to close the second end of the ventilation channel to prevent ventilation of the container through the channel, and wherein the annular seal comprises an annular lip which forms the hole rim and is pressed radially inward in the form of a truncated cone across an annular space in the ventilation channel against the cylindrical outside of the pump housing so as to seal the second end of the ventilation channel, the annular lip having a radial thickness that provides a radial space between the annular lip and the retainer.

16. The dispenser pack according to claim 15, wherein the thickness of the annular lip is reduced towards its outer end.

17. The dispenser pack according to claim 15, wherein the medium within the container is enclosed by a bag made of a flexible material, with the upper aperture rim of that bag being tightly connected to the wall of the container, while in a space between the inside of the container wall and the outside of the bag air at atmospheric pressure is contained.

18. The dispenser pack according to claim 17, wherein the bag and the container have been formed in one piece.

19. The dispenser pack according to claim 17, wherein the aperture rim of the bag has been injection-moulded to the bottom end of the container neck.

20. The dispenser pack according to claim 15, wherein an upper end of the pump housing comprises an aperture and a lower end of the pump housing comprises a suction pipe nipple.

21. The dispenser pack according to claim 20, wherein the aperture of the suction pipe nipple is freely exposed.

* * * * *

UNITED STATES PATENT AND TRADEMARK OFFICE

CERTIFICATE OF CORRECTION

PATENT NO. : 8,534,506 B2
APPLICATION NO. : 10/566563
DATED : September 17, 2013
INVENTOR(S) : Karsten Bohnisch and Bernhard Jasper It is certified that error appears in the above-identified patent and that said Letters Patent is hereby corrected as shown below:

On the Title page, Item (73), after the heading "Assignee:", the name "Seaquist Perfect Dispensing, GmbH" should be -- Aptar Dortmund GmbH --

Signed and Sealed this
Fourth Day of February, 2014

Michelle K. Lee

Michelle K. Lee
*Deputy Director of the United States Patent and Trademark Office*